US009303371B2

(12) United States Patent
Stephens

(10) Patent No.: US 9,303,371 B2
(45) Date of Patent: Apr. 5, 2016

(54) BEARING PRESET SYSTEM

(75) Inventor: Ian John Stephens, Brickendonbury (GB)

(73) Assignee: Tun Abdul Razak Research Centre, Hertfordshire (GB)

( * ) Notice: Subject to any disclaimer, the term of this patent is extended or adjusted under 35 U.S.C. 154(b) by 0 days.

(21) Appl. No.: 14/234,114

(22) PCT Filed: Jul. 20, 2012

(86) PCT No.: PCT/GB2012/051748

§ 371 (c)(1),
(2), (4) Date: Jan. 21, 2014

(87) PCT Pub. No.: WO2013/014429

PCT Pub. Date: Jan. 31, 2013

(65) Prior Publication Data

US 2014/0161378 A1 Jun. 12, 2014

(30) Foreign Application Priority Data

Jul. 22, 2011 (GB) ..... 1112650.5

(51) Int. Cl.
*F16C 41/00* (2006.01)
*E01D 19/04* (2006.01)
*E04B 1/36* (2006.01)

(52) U.S. Cl.
CPC ..... *E01D 19/04* (2013.01); *E01D 19/041* (2013.01); *E04B 1/36* (2013.01)

(58) Field of Classification Search
CPC ..... E01D 19/04; E01D 19/041; E01D 19/042; E01D 19/048; E04B 1/36; F16C 27/02; F16C 27/06; F16C 27/08; F16C 41/00; F16C 41/02
USPC ..... 384/36, 37, 41, 42, 624, 627; 52/167.1–167.9; 14/73.5, 77.1
See application file for complete search history.

(56) References Cited

U.S. PATENT DOCUMENTS 3,329,472 A * 7/1967 Donnellan ..... 384/36
3,398,998 A * 8/1968 Burnett ..... 14/73.5

(Continued)

FOREIGN PATENT DOCUMENTS

DE 102007010778 A1 9/2007
JP 10212708 A 8/1998
JP 2000027121 A 1/2000

(Continued)

OTHER PUBLICATIONS

Translation JPH10212708 obtained May 6, 2015.*

*Primary Examiner* — James Pilkington
(74) *Attorney, Agent, or Firm* — Bret E. Field; Bozicevic, Field & Francis LLP

(57) ABSTRACT

A bearing preset system for inhibiting movement of bearings in a construction comprises a first plate (1) having an upper and a lower surface wherein the upper surface (3) of the first plate is adapted for mounting onto and being secured to a lower surface of a first bearing member and a second plate (2) having an upper and a lower surface wherein the lower surface (5) of the second plate is adapted for mounting onto and being secured to an upper surface of a second bearing member and wherein the conformation of the lower surface (7) of the first plate and the conformation of the upper surface (9) of the second plate are such as to prevent movement in at least one shear direction between the first and second plates.

7 Claims, 2 Drawing Sheets

(56) References Cited

U.S. PATENT DOCUMENTS 5,597,240 A * 1/1997 Fyfe ..... 384/36
6,178,706 B1 1/2001 Nomoto et al.

FOREIGN PATENT DOCUMENTS

JP 2000282411 A 10/2000
JP 2004068276 A 3/2004

* cited by examiner

BEARING PRESET SYSTEM

INTRODUCTION

SUMMARY

The present invention relates to a locking system for use in the construction industry to inhibit movement of bearings during construction. In particular, the locking system of the invention has use in earthquake or other civil engineering applications, for instance in the construction of bridges.

Rubber-steel laminated bearing systems used in the construction industry are designed to isolate structures from dynamic loads resulting, for instance, from seismic events, ground borne vibrations, wind loading and vehicle impact. The change in the length of the superstructure of bridges due to shrinkage can be significant for long decks resulting in large shear deflections in rubber-steel laminated bridge bearings dining the first few months after their installation. The strategies adopted can be either to lift the deck after the completion of shrinkage process to allow the rubber bearings to return to their neutral position or to lock the rubber bearings after manufacture in a pre-deform shear equal, but opposite in direction, to the predicted changed in the local position of the deck due to shrinkage. After the installation of the rubber bearings, the locking mechanism is then removed allowing the bearings to gradually return to their neutral position as shrinkage in the deck progresses. A bridge bearing provides an interface between the superstructure of the bridge (deck) and its substructure (piers) and functions to transfer loads during movements of the deck to the substructure and foundations. The bearings allow for rotation caused by dead and live loads and permit horizontal movement of the superstructure due to thermal expansion and contraction without imposing excessive load on the substructure. Furthermore, a change in the height of rubber-steel laminated bearings can occur due to the imposition of shear deformation or vertical load on the bearing.

The installation of bearings is often rendered more complex by the need to accommodate changes caused as a result of, for instance, the slow shrinkage of concrete structures as the concrete cures or, for instance, dynamic factors such as transient wind effects. The consequence of these and other factors is that the designed compliance of the bearings, in one or more modes, may need to be temporarily inhibited during construction and, then, at a later time released from the inhibition.

The present invention provides a locking system for inhibiting movement of bearings in a construction which comprises a first plate having an upper and a lower surface wherein the upper surface of the first plate is adapted for mounting onto and being secured to a lower surface of a first bearing member and a second plate having an upper and a lower surface wherein the lower surface of the second plate is adapted for mounting onto and being secured to an upper surface of a second bearing member and wherein the conformation of the lower surface of the first plate and the conformation of the upper surface of the second plate are such as to prevent movement in at least one shear direction between the first and second plates. The locking system of the invention allows for the change in the height of the bearing while maintaining a pre-defined horizontal deformation in the bearing. Thus, the system of the invention not only removes the uncertainty in the magnitude of the vertical load supported by the bearing during the construction but also eliminates the need for the use of fixtures between the locking system and the bearing capable of supporting large vertical loads.

The opposing surfaces of the first and second plates, i.e., the lower surface of the first plate and the upper surface of the second plate, have conformations which prevent movement between the two plates in at least one horizontal direction. For instance, the lower surface of the first plate and the upper surface of the second plate may each have protruding surfaces, for example lugs, which, in use abut each other and which, therefore, prevent movement of one or both plates in the direction of the protruding surfaces. In such a case, movement in one shear direction is prevented while allowing free linear movement and limited rotation in other directions. Movement of the plates in two shear directions may be prevented by a conformation on the lower surface of the first plate which interlocks or engages with an opposing conformation on the upper surface of the second plate, for instance a recess in the surface of one plate and a lug on the opposing surface of the other plate, which engages with the recess so as to constrain movement between the plates.

Bearing fixing systems conventionally comprise the use of mechanical anchors and specialised grouting/adhesive compositions. However, such grouting/adhesive compositions need to set and/or cure in order to develop maximum strength. Strain can be put on the bearing fixing system when the supported structure undergoes slight displacement such as during cycles of expansion and contraction. According to a preferred embodiment of the invention, the locking system is provided with means to allow small displacements, while still resisting the preset shear force restrained in the bearing itself, so as to protect the bearing fixing system while the grouting/adhesive system is setting/curing. The means which is designed to yield and/or bend, without ultimate failure, at a predetermined force, acts as a mechanical fuse and, thus, acts to alleviate strain or overload on the bearing fixing system while the grouting/adhesive composition is setting/curing. The means may comprise one or more ligaments attached to one or both lugs of the first and/or second plates.

The system of the invention allows bearings, such as rubber-steel laminated bearings or elastomeric bearings, to be set up with locked-in shear deflection so that when installed they are preset in horizontal shear to accommodate, for example, medium term shrinkage of the cast concrete bridge deck. When the bearing installation is complete, the preset system may be removed, and the bearing is then free to accommodate all movements required of it.

The first and second plates of the system of the invention may typically be formed of iron or its alloys, for example steel and produced typically by flame cutting or water jet cutting techniques.

The system of the invention also has use in the testing of bearings in various modes. Some of the standards on seismic isolators require bearings to be tested under extreme conditions predicted to occur during an earthquake. The testing conditions may require the bearings to be held at large shear deflection while a tensile force is imposed on the bearings, i.e. a bi-directional input. Normally, for testing purposes, a bearing will be placed in an hydraulic testing press to apply a compressive or stabilising force on the bearing. The use of various ancillary equipment enables the application of other forces or displacements. The system, according to the present invention, may be used for bearing testing in a simplified testing press or even without the need for any testing press. According to such a use, one or more hydraulic rams may be located so as to apply force on, or against, a plate in the system. The one or more rams can be located to apply shear, torsion, rotation, tension (uplift) or compression to the bearing on test so that the effect of peak dynamic loads, such as those occurring during seismic events, on the bearings can be investigated and/or evaluated.

BRIEF DESCRIPTION OF THE FIGURES

In order that the invention can be fully understood and readily carried into effect, the same will now be described by way of example only, with reference to the accompanying drawings, of which.

DETAILED DESCRIPTION

Figure 1:
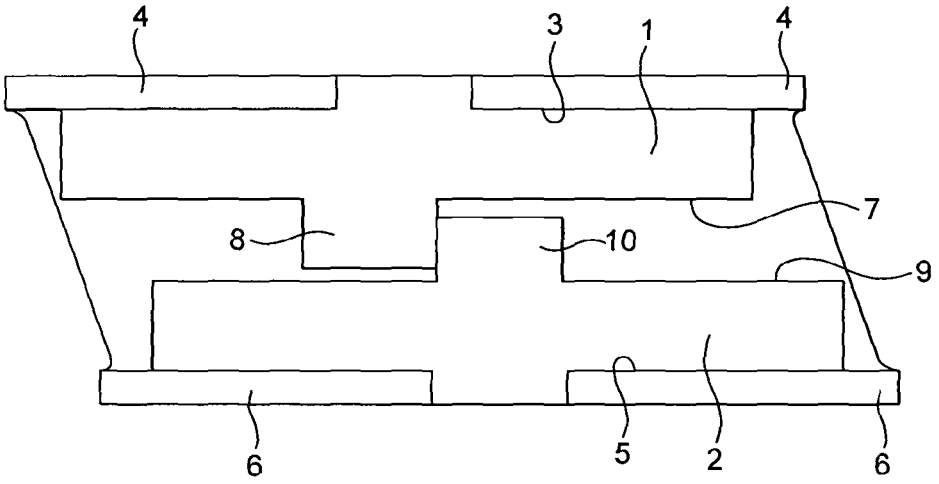
FIG. 1 is a diagrammatic laterally symmetrical side elevation of an embodiment of the locking system of the present invention, in use.

As shown in FIG. 1, the locking system of the invention comprises a first plate 1 and a second plate 2. The first plate 1 is mounted at its upper surface 3 to the lower surface of a first bearing member (not shown) by mounting plates 4. The second plate 2 is mounted at its lower surface 5 to the upper surface of a second bearing member (not shown), located beneath the first bearing member, by mounting plates 6.

The lower surface 7 of the first plate 1 is provided with a lug 8. The upper surface 9 of the second plate 2 is provided with a lug 10. Lug 8 of plate 1 abuts lug 10 of plate 2 and thus movement of plate 1 and/or plate 2 is inhibited in one shear direction.

The use of the system allows a bearing to be set up with locked in shear deflection so that when installed it is preset in horizontal shear. Once the bearing installation is complete, the system may be removed, thus leaving the bearing in a neutral or nominally zero shear condition and with freedom to accommodate all movements required of it.

Figure 2:
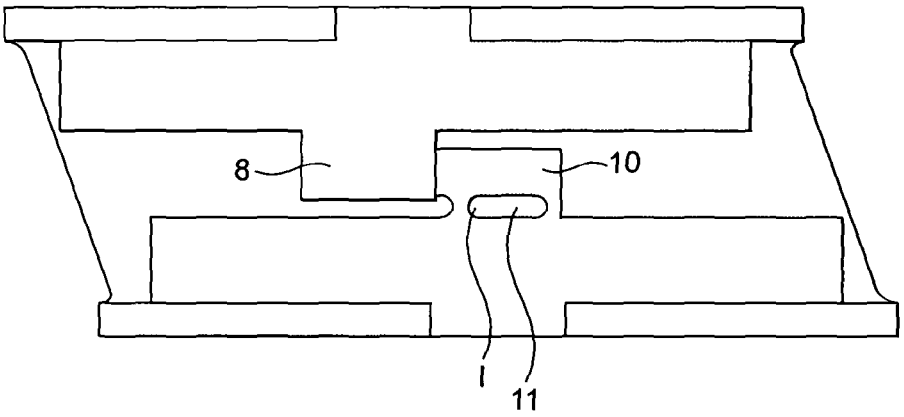
FIG. 2 is a diagrammatic laterally symmetrical side elevation of a different embodiment of the invention, in use.

The system shown in FIG. 2 is provided, in lug 10 with a means to provide protection for the bearing fixing system, which may comprise mechanical anchors and specialised grouting or adhesive, while the grouting or adhesive is setting. According to this embodiment, a slot 11 is provided in lug 10. One or more ligaments, l, formed from a ductile material and adapted to yield or bend, without ultimate failure, at a predetermined force, are located in slot 11. According to a preferred embodiment, two ligaments are provided in the slot. Thus, when the lug 8 moves towards the right, force is applied on lug 10. This force is resisted by the one or more ligaments which can go into plastic deformation if the magnitude of the force is large enough to cause stress in the lugs to go beyond the elastic limit of the material. The size of the ligaments, lugs and/or slot, can be chosen so as to achieve the desired level of force to plastically deform the ligaments, i.e. to act as a mechanical fuse, thereby ensuring that the force does riot increase beyond a safe limit for the grout or adhesive to cure. This allows for displacement due to short (for instance, daily) cycles of expansion and contraction of the supported structure while still resisting the preset shear force restrained in the bearing itself. This mechanical fuse, thus, protects an anchor/grout/adhesive system used from overload until cure of the grout/adhesive is complete. After completion of the cure, the preset locking system can be removed. The mechanical fuse, shown in FIG. 2, is located in lug 10, However, the mechanical fuse may, alternatively, be provided in lug 8 or in both lugs 8 and 10 depending on the compliance required.

Figure 3:
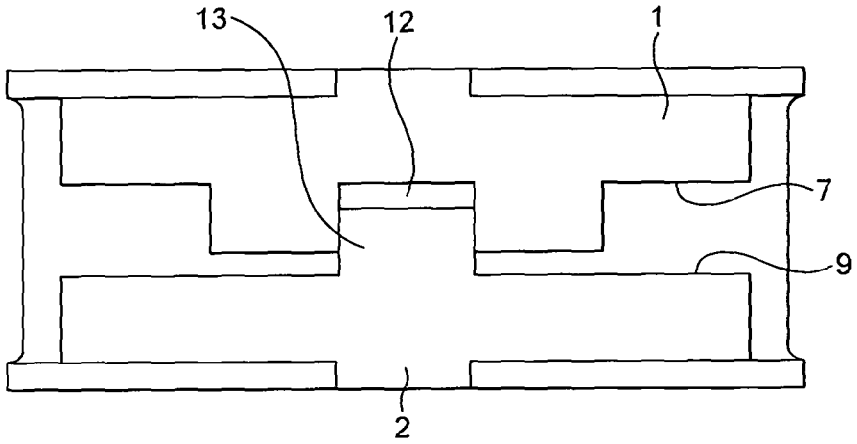
FIG. 3 is a diagrammatic laterally symmetrical side elevation of a yet further embodiment of the present invention, in use.

As shown in FIG. 3, a locking system according to the present invention may be designed to prevent movement in two shear directions. Specifically, as shown in FIG. 3, the lower surface 7 of the first plate 1 is provided with a recessed section 12 and the upper surface 9 of the second plate 2 is provided with a protruding part or lug 13 designed to interengage securely into the recessed section 12. Alternatively, the upper surface of the second plate 2 can be provided with one or more recessed sections which interengage with one or more lugs provided on the lower surface of the first plate 1.

Figure 4:
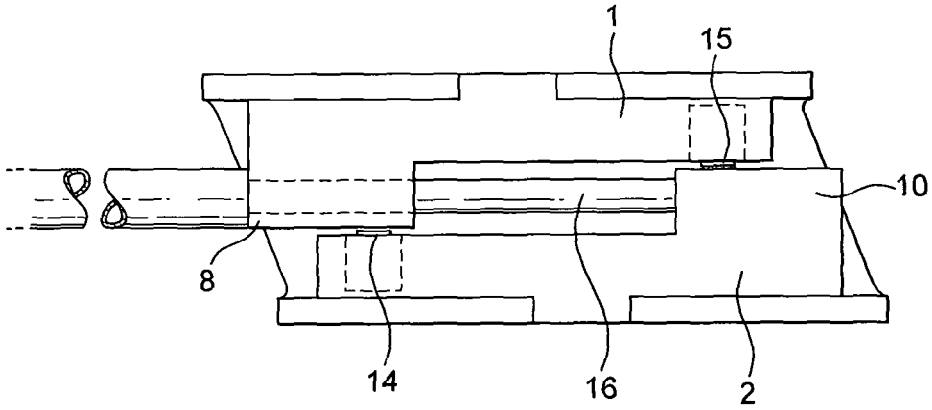
FIG. 4 illustrates the use of a locking system according to the present invention in testing of bearings.

FIG. 4 illustrates an embodiment of the use of the locking system of the invention in a method of assessing the effect on a bearing of the application of bi-directional quasi-static or dynamic load. FIG. 4 shows short hydraulic 'pot' ram 14 acting upwardly against a lower surface of lug 8 on the first plate 1 of the system, a short hydraulic 'pot' ram 15 acting downwardly against an upper surface of lug 10 on the second plate 2 of the system and a long hydraulic ram 16 acting against an inside side surface of lug 10.

FIG. 4 has to be viewed with the understanding that there is lateral symmetry and that there is also a long hydraulic ram acting against an inside side surface of lug 8 and two further short hydraulic 'pot' rams corresponding to rams 14 and 15, respectively, such that there are two short rams and one long ram for each of the pair of adapted locking plates 1 and 2. These further short and long rams are not illustrated in FIG. 4 for the sake of simplicity.

If two laterally-opposed 'pot' rams are energised, the bearing is rotated. If all four 'pot' rams are energised, the bearing is put in tension. If the two long rams are energised, the bearing is sheared. If the adapted locking plates and long rams are handed, the bearing is subject to torsion.

The application of various forces, separately or in any combination (biaxial input), using constant input and/or using a cyclic or intermittent input may be considered to replicate the conditions that would be expected to occur in service. The measurement of loads applied and the determination of the effects of the deformations instrumentally and/or visually enables the performance of the bearing to be assessed. This might be required for a variety of reasons, for example, to check if the bearing can take the extreme loads or to study the long term performance of the bearing under constant biaxial input or even the cyclic life of the bearings if the input is cyclic.

The invention claimed is:

1. A locking system for inhibiting movement of bearings in a construction, the locking system comprising:

a first plate having an upper and a lower surface, wherein the upper surface of the first plate is configured for mounting onto a lower surface of a first bearing member; and a second plate having an upper and a lower surface, wherein the lower surface of the second plate is configured for mounting onto an upper surface of a second bearing member, wherein the locking system has a height from the lower surface of the second plate to the upper surface of the first plate, and wherein the lower surface of the first plate and the upper surface of the second plate are configured to prevent movement in at least one shear direction between the first and second plates and to allow for a change in the height of the locking system.

2. The locking system according to claim 1, wherein the lower surface of the first plate has a downwardly projecting lug and the upper surface of the second plate has an upwardly projecting lug, and wherein the upwardly projecting lug on the second plate abuts the downwardly projecting lug on the first plate and prevents movement in one shear direction between the first and second plates.

3. The locking system according to claim 1, further comprising one or more ligaments, to allow small displacements, and the ligaments are capable of yielding and/or bending, without ultimate failure, at a predetermined force.

4. The locking system according to claim 1, wherein the lower surface of the first plate has a recessed area and the upper surface of the second plate has a shape adapted to mate with the recessed area of the lower surface of the first plate such that the upper surface of the second plate engages with the recessed area of the lower surface of the first plate so as to prevent movement in two shear directions between the first and second plates.

5. The locking system according to claim 1, wherein the upper surface of the second plate has a recessed area and the lower surface of the first plate has a shape adapted to mate with the recessed area of the upper surface of the second plate such that the lower surface of the first plate engages with the recessed area of the upper surface of the second plate so as to prevent movement in two shear directions between the first and second plates.

6. The locking system according to claim 1, wherein the construction is a bridge.

7. A method comprising:

inhibiting movement of bearings in a construction by employing the locking system of claim 1; and assessing the effects on a bearing when subject to a bi-directional quasi-static or dynamic load.

* * * * *